US007021439B2

(12) United States Patent
Yoon et al.

(10) Patent No.: US 7,021,439 B2
(45) Date of Patent: Apr. 4, 2006

(54) CLUTCH APPARATUS

(75) Inventors: Young-min Yoon, Yongin (KR); Byoong hwa Ahn, Seongnam (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 19 days.

(21) Appl. No.: 10/736,845

(22) Filed: Dec. 17, 2003

(65) Prior Publication Data

US 2004/0124056 A1 Jul. 1, 2004

(30) Foreign Application Priority Data

Dec. 18, 2002 (KR) ..... 10-2002-0081463

(51) Int. Cl.
*F16D 27/105* (2006.01)

(52) U.S. Cl. ..... 192/26; 192/81 C; 192/84.84

(58) Field of Classification Search ..... 192/84.84, 192/81 C, 41 S, 33 C, 26, 12 BA
See application file for complete search history.

(56) References Cited

U.S. PATENT DOCUMENTS

| | | | | |
|---|---|---|---|---|
| 4,191,283 | A * | 3/1980 | Keeny, III | 192/26 |
| 4,193,483 | A * | 3/1980 | Ariga et al. | 192/26 |
| 4,529,188 | A | 7/1985 | Sturnick | |
| 4,586,813 | A * | 5/1986 | Ide | 355/50 |
| 4,848,545 | A * | 7/1989 | Nishimura | 192/26 |
| 5,101,944 | A * | 4/1992 | Kawai | 192/12 BA |
| 5,235,381 | A * | 8/1993 | Namiki et al. | 355/72 |
| 5,711,405 | A * | 1/1998 | Tamehira | 192/26 |
| 5,860,645 | A * | 1/1999 | Tomura et al. | 271/10.13 |

FOREIGN PATENT DOCUMENTS

| | | | |
|---|---|---|---|
| EP | 0 464 785 | A2 | 1/1992 |
| EP | 0 921 082 | A1 | 6/1999 |
| JP | 60-204533 | | 10/1985 |
| JP | 61229728 | A * | 10/1986 |

OTHER PUBLICATIONS

European Search Report dated Mar. 24, 2004, including Abstract of corresponding European Patent Application No. 03257678.7 from the European Patent Office.

* cited by examiner

*Primary Examiner*—Richard M. Lorence
(74) *Attorney, Agent, or Firm*—Staas & Halsey LLP

(57) ABSTRACT

Disclosed is a clutch apparatus for use in two-phase position control, which includes a clutch housing for supporting and rotating together with the shaft and a driving gear for selectively driving the housing in a rotatable manner with the help of a clutch intervened between the housing and the driving gear. The clutch apparatus has a solenoid unit for supporting the housing and is capable of being selectively on/off-controlled. The housing has an initial position controlling protuberance interfered with the solenoid unit in its on-state, for determining an initial position of the object, and a pair of phase protuberances interfered with the solenoid unit in its off-state, for suppressing rotation of the housing at each of the two phase positions of the object.

14 Claims, 5 Drawing Sheets

CLUTCH APPARATUS

CROSS-REFERENCE TO RELATED APPLICATIONS

This application claims the priority of Korean Patent Application No. 2002-81463, filed Dec. 18, 2002 in the Korean Intellectual Property Office, the disclosure of which is incorporated herein by reference.

BACKGROUND OF THE INVENTION

1. Field of the Invention

The present invention relates to a clutch apparatus for controlling two-phase positions of a rotating body.

2. Description of the Related Art

Generally, in the case of a laser color printer, a plurality of developing units for developing an image for each color is installed around a photoconductive medium. Therefore, if the developing unit for each color sequentially forms a color image on the photoconductive medium, the formed color images are sequentially transferred to and overlapped on a transferring belt. After that, the overlapped color images formed in such a manner are transferred to a transferring roller rotated by contacting the transferring belt and a paper passing through the transferring belts and the transferring roller. Finally, a paper on which the color image is transferred is discharged after passing through a fixing unit. The laser color printer operating in such a manner has a cam operating apparatus capable of separating the transferring roller from the transferring belt while the color images are formed and overlapped on the transferring belt, and of bringing the transferring roller into contact with the transferring belt so that the color images are completely formed and overlapped.

Also, the cam operating apparatus selectively operates on or off with the help of a clutch apparatus capable of controlling two-phase positions, thereby controlling a position of a member such as the transferring roller for which two-phase position control is required.

FIG. 1 shows a conventional clutch apparatus for two-phase position control, which includes: an axis part 10 on which a shaft 12 having a cam 11 is fixed; a driving gear 13 having a spring clutch (not shown) intervened, for being selectively rotatable with respect to the axis part 10; and a solenoid 20 on which the axis part 10 is supported in a rotatable manner, for controlling rotational position by selectively providing a load on the axis part.

According to the foregoing construction, if the solenoid 20 is turned on, while the driving gear 13 and the shaft 12 are rotated together by clutch operation, the first phase protuberance 10*a* projected on the outer periphery of the axis part 10 is hooked by a switch member 21 of the solenoid 20 as shown by a virtual line. Thus, at this status, the first phase of the cam 11 is position-controlled.

Also, in order to perform position control for the second phase of the cam 11 by rotating the cam 11 as much as 180 degrees, the solenoid 20 is turned off. Then, the switch member 21 is moved to a position as shown by a solid line. After that, while driving gear 13 is rotated together with the shaft 12 and the axis part 10, the second phase protuberance 10*b* is hooked by the switch member 21. At that moment, rotation of the shaft 12 is stopped by clutch operation. By such operation, the second phase of the cam 11 is position-controlled.

The conventional clutch apparatus having the foregoing construction should constantly maintain the solenoid at its on-status in order to maintain any position out of two phase-positions. In that case, power consumption increases constantly, and the solenoid 20 is overheated, so that magnetic force weakens and the sticking force of the switch member 21 deteriorates. Therefore, there may occur a case that position control is not properly performed. Also, the switch member 21 is magnetized, so that the separating time is lengthened when the solenoid is turned off, whereby exact cam operation is not appropriately performed.

SUMMARY OF THE INVENTION

Accordingly, the present invention has been developed to solve the above-mentioned problems occurring in the related art, and an aspect of the present invention is to provide a clutch apparatus having an improved structure, capable of performing two-phase position control using low power.

In an aspect of the present invention a clutch apparatus is provided for performing two-phase position control for a two phase-positioned object installed on a shaft, the clutch apparatus comprising: a clutch housing for rotating together with the shaft, supporting the same; a driving gear installed on the housing, for being rotatable and for selectively driving the housing in a rotatable manner with the help of a clutch intervened between the housing and the driving gear; and a solenoid unit for supporting the housing and for being selectively on/off controlled, wherein the housing has an initial position controlling protuberance interfered with the solenoid unit in its on-state, for determining an initial position of the object, and a pair of phase protuberances interfered with the solenoid unit in its off-state, for suppressing rotation of the housing at each of the two phase positions of the object.

In an alternative aspect of the invention, a pair of the phase protuberances is projected on the outer periphery of the housing, and correspond to a position of the switch member in its off-state that is changed by on/off operation of the solenoid unit.

Alternatively, a pair of the phase protuberances is positioned on the same circumference in the outer periphery of the housing.

In an alternative aspect, a pair of the phase protuberances is installed symmetrically with respect to the shaft.

In an alternative aspect, the initial position controlling protuberance is prepared on a position that forms an angle of 90 degrees in the circumferential direction with respect to each of the phase protuberances.

Alternatively, interference between the solenoid unit and either of the phase protuberances is released by instant on/off operation of the solenoid unit so that phase conversion may be possible.

The foregoing and other aspects of the present invention are also achieved by providing a position control clutch device having a driving gear and clutch connectable for rotation with a housing. A shaft is connectable for rotation with the housing at one end and has an object at the opposite end and a solenoid unit that is adapted to rotatably support the housing and for selectively engaging protuberances on the surface of the housing with a switch member. The switch member engages an initial position controlling protuberance when the solenoid unit is in an on state and the switch member selectively engages either a first phase protuberance or a second phase protuberance when the solenoid is in an off state, whereby the position of the object at the end of the shaft is controlled in set phases by turning the solenoid on and off.

The foregoing and other objects of the present invention are also achieved by providing a position control clutch device having a housing rotatably coupled to a shaft, where the shaft has a cam at a free end that is in common rotation with the shaft. A driving gear and clutch are connectable for selective rotation with the housing. A solenoid unit is adapted to rotatably support the housing and for selectively engaging the housing with a switch member, where the switch member selectively engages an initial position controlling protuberance on the surface of the housing when the solenoid unit is on, and a first phase protuberance or a second phase protuberance on the surface of the housing when the solenoid is off. Thus, the position of the cam may change phase by cycling the solenoid on and off.

Additional aspects and/or advantages of the invention will be set forth in part in the description which follows and, in part, will be obvious from the description, or may be learned by practice of the invention.

BRIEF DESCRIPTION OF THE DRAWINGS

The above and/or other aspects, features and advantages of the present invention will become more apparent from the following detailed description of the embodiments when taken in conjunction with the accompanying drawings, in which.

DETAILED DESCRIPTION OF THE EMBODIMENTS

Figure 1:
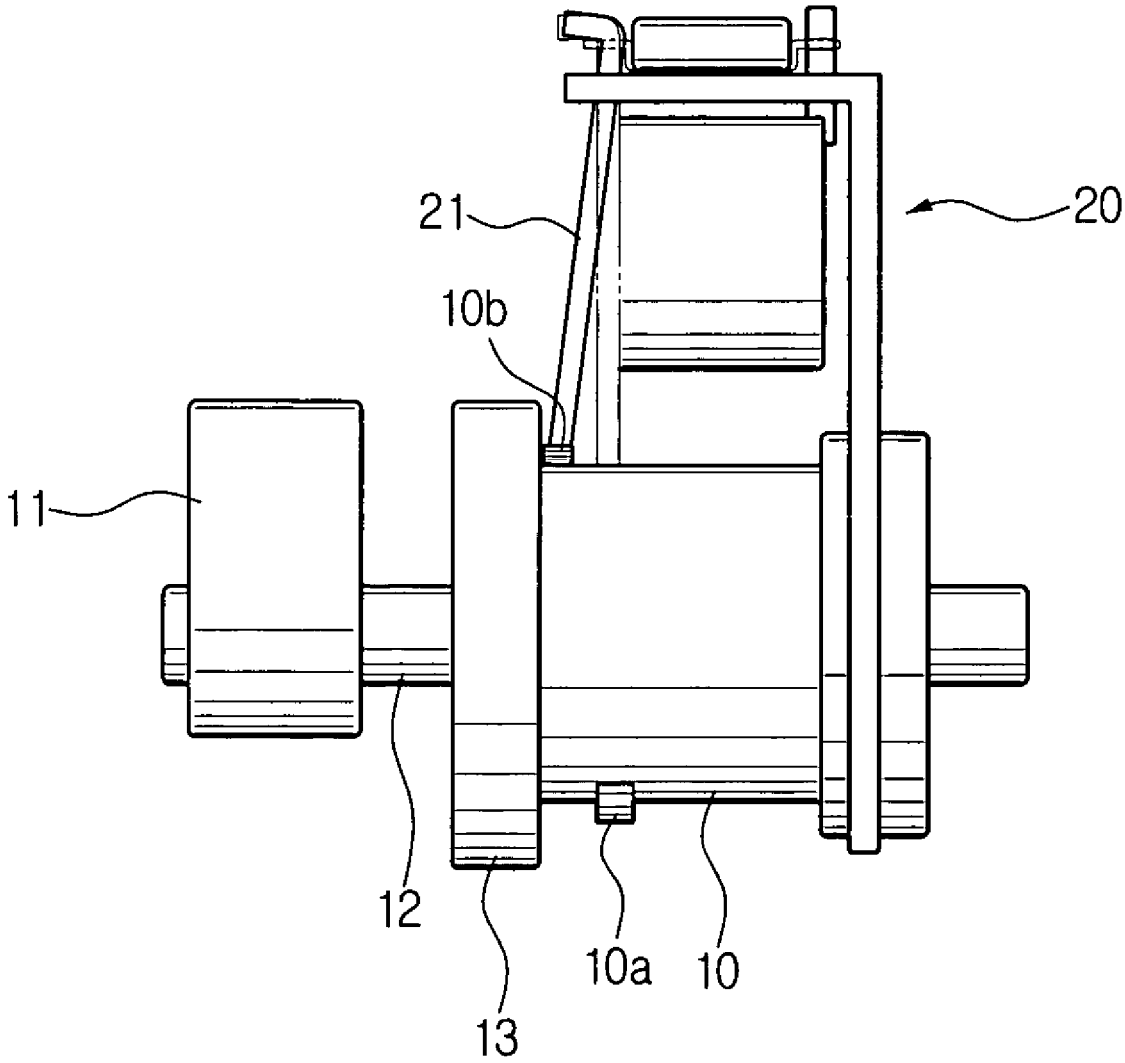
FIG. 1 (PRIOR ART)
FIG. 1 is a side view schematically showing a conventional clutch apparatus.

Reference will now be made in detail to the present embodiments of the present invention, examples of which are illustrated in the accompanying drawings, wherein like reference numerals refer to like elements throughout. The embodiments are described below in order to explain the present invention by referring to the figures. The matters defined in the description such as a detailed construction and elements are simply provided to assist in a comprehensive understanding of the invention. Thus, it is apparent that the present invention can be carried out without those defined matters. Also, well-known functions or constructions are not described in detail since they would obscure the invention in unnecessary detail.

Figure 2:
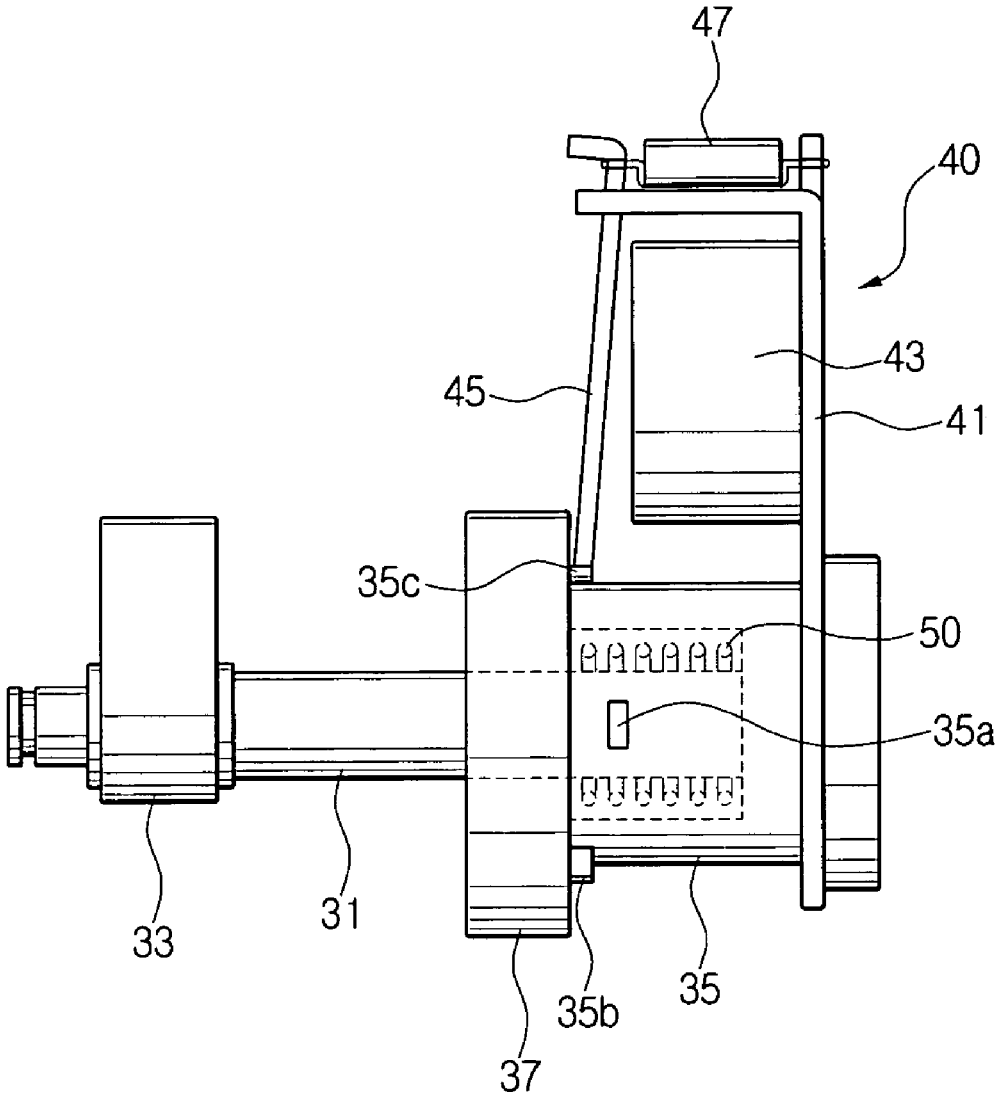
FIG. 2 and FIG. 3 are side views schematically showing a clutch apparatus according to an embodiment of the present invention.

Referring to FIG. 2, a clutch apparatus according to an embodiment of the present invention is for controlling a two phase-positioned object installed on a shaft 31, i.e., two-phase positions of a cam 33. The clutch apparatus has a clutch housing 35 joined to the shaft 31, for rotating together with the shaft 31; a driving gear 37 joined to the housing 35; and a solenoid unit 40, that may be turned on or off, for supporting the housing 35.

The eccentric cam 33 is supported by and rotated together with the shaft 31. The shaft 31 is fit into an axis hole of the housing 35 and is rotated together with the housing 35. The housing 35 is supported in a rotatable manner by a supporting frame 41 of the solenoid 40.

Also, a clutch 50 is intervened between the housing 35 and the driving gear 37. Namely, a spring clutch, which is widely used and is well known, is installed between the housing 35 and the driving gear 37, for selectively delivering the rotational force of the driving gear 37 to the housing 35. Therefore, if a load is provided on the housing 35, the driving gear 37 runs idle. Here, the driving gear 37 is given power for rotation from a predetermined power transferring unit.

The solenoid unit 40 has a supporting frame 41 for supporting the housing 35 in a rotatable manner; a solenoid operating unit 43 installed in the supporting frame 41; a switch member 45 that is selectively attached to and separated from the solenoid operating unit 43 by turning the solenoid operating unit 43 on or off. The switch member 45 is elastically-biased by a spring 47, to maintain separation from the operating unit 43 upon turn-on of the operating unit 43 as shown in FIG. 2.

The housing 35 has, on its outer periphery, an initial position controlling protuberance 35*a* for determining an initial position of the cam 33 and a pair of phase protuberances 35*b* and 35*c*.

Figure 3:
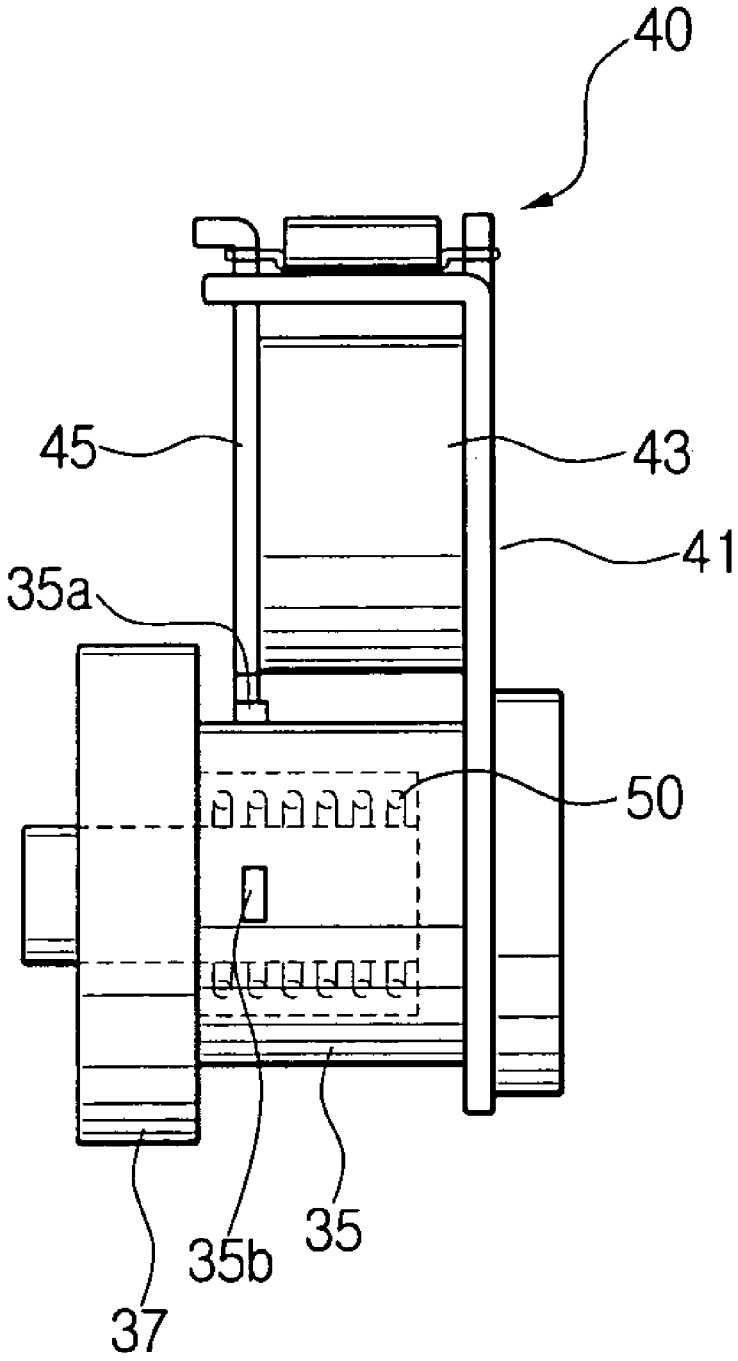

The initial position controlling protuberance 35*a* is formed on the housing 35 at a position between the phase protuberances 35*b* and 35*c*, where the initial position controlling protuberance 35*a* itself is interfered with the switch member 45 upon turn-on of the solenoid unit 40. Namely, as shown in FIG. 3, during the on-state where the switch member 45 is attached to the operating unit 43, while the driving gear 37 and the housing 35 are rotated together, the initial position controlling protuberance 35*a* is interfered with the switch member 45. Therefore, at that point, the housing 35 is not rotated and the driving gear 37 runs idle.

The phase protuberances 35*b* and 35*c* are for suppressing rotation of the housing 35 at each of two phase positions of the cam 33 once the initial position has been determined as described above, and are projected at an 180 degree interval with respect to each other on the housing 35. The phase protuberances 35*b* and 35*c* are symmetric with respect to each other around the shaft 31. Also, the phase protuberances 35*b* and 35*c* are positioned on the same circumferential line of the housing 35, and each is positioned, to form an angle of 90 degrees with respect to the initial position controlling protuberance 35*a*. The phase protuberances 35*b* and 35*c* having such construction control a phase of the cam 33 by being interfered with the switch member 45 and suppressing rotation of the housing 35 when the solenoid unit 40 is in the off-state as shown in FIG. 2. As shown in FIG. 2, in the second phase where the long radius of the cam faces the upper side, the switch member 45 comes into contact with the second phase protuberance 35*c*, suppressing rotation of the housing 35. In order to move the cam 33 to the first phase where the long radius of the cam 33 is positioned to the lower side, the solenoid unit 40 is instantly turned-on and off while the driving gear 37 is being rotated. Then, the switch member 45 is detached from the second phase protuberance 35*c* and restored to its original position and subsequently is rotated as much as 180 degrees, then the first phase protuberance 35*b* touches or interferes with the switch member 45, whereby the position of the housing 35 is fixed. Therefore, the cam 33 is maintained at the first phase position.

Operation of the clutch apparatus according to an embodiment of the present invention having the foregoing construction will be described in more detail with reference to FIG. 2 through FIG. 7 in the following.

Figure 4:
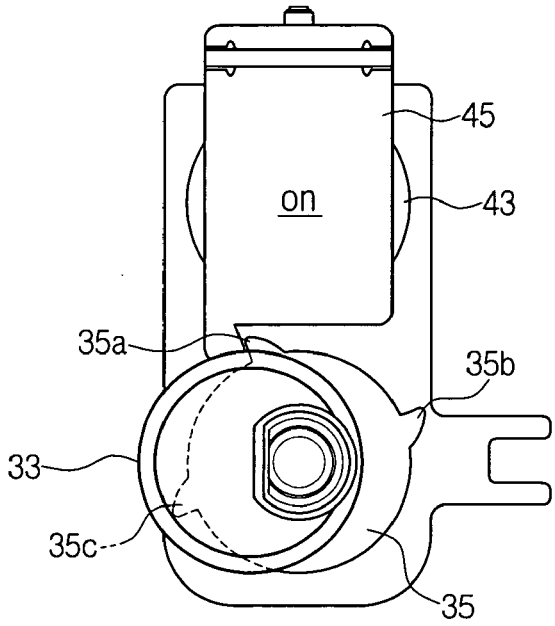
FIG. 4 through FIG. 7 are front views explaining operations of a clutch apparatus according to an embodiment of the present invention, respectively.

To determine the initial position of the cam 33, the solenoid unit 40 is turned on when power is transferred to the driving gear 37. Then, as shown in FIG. 3, the switch member 45 is attached to the operating unit 43. After that, while rotating together with the driving gear 37, the housing 35 stops the moment the controlling protuberance 35*a* comes into contact with the switch member 45. As described, when the controlling protuberance 35*a* is attached to the switch member 45 the initial status of the cam 33 is set. As shown in FIG. 4, the initial position of the cam 33 is such that the long radius of the cam 33 is horizontally positioned.

Figure 5:
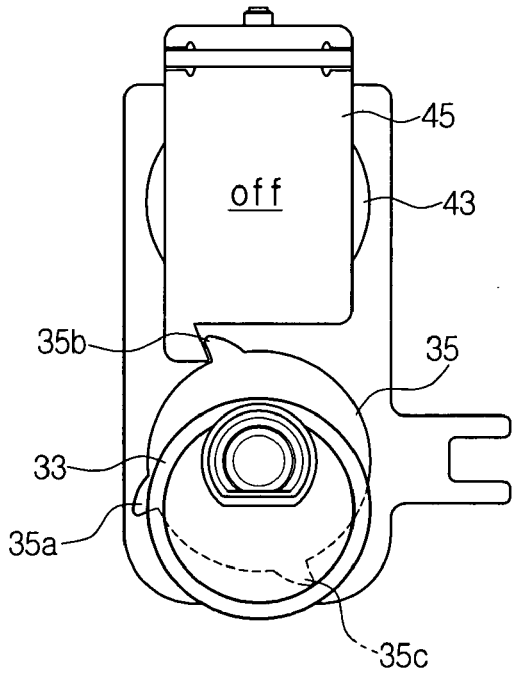

To move the position of the cam 33 to the first phase where the long radius of the cam 33 faces the lower side, the solenoid unit 40 is turned off. Then, the switch member 45 is separated from the operating unit 43 and moved to the position shown in FIG. 2. This separates the controlling protuberance 35*a* from the switch member 45 and the housing 35 is rotated together with the driving gear 37. When rotated approximately 90 degrees, the housing 35 stops the moment the first phase protuberance 35*b* comes into contact with the switch member 45, becoming the state as shown in FIG. 5. Namely, if the first phase protuberance 35*b* is hooked at the switch member 45, power is not transferred to the housing 35, thus the cam 33 remains fixed at the first phase.

Figure 6:
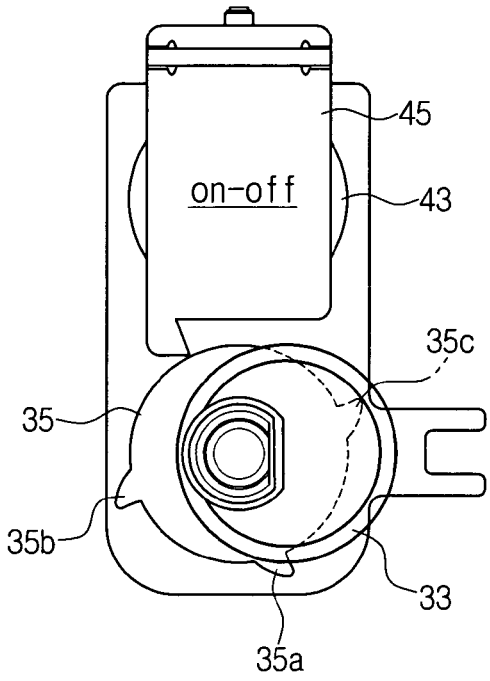
Figure 7:
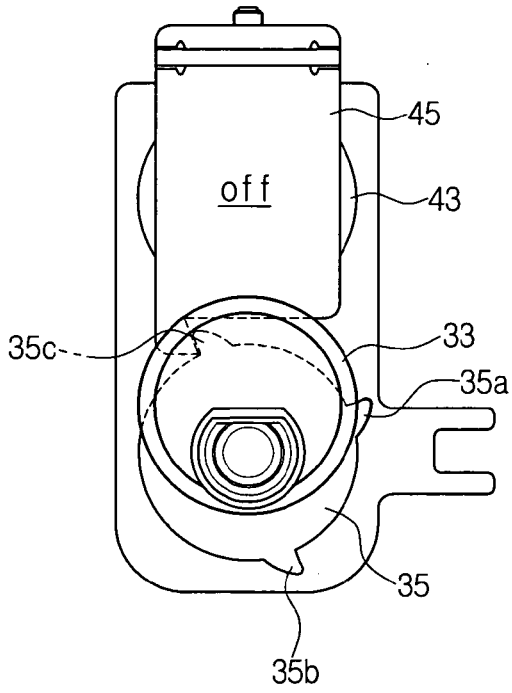

Starting from the above state shown in FIG. 5, in order to change the position of the cam 33 to the second phase, the solenoid unit 40 is instantly turned on and off (with an interval of about 1–2 seconds). Then, while the switch member 45 is separated from the first phase protuberance 35*b* and instantly attached to and detached from the operating unit 43, the housing 35 is rotated as shown in FIG. 6. Therefore, the cam 33 is rotated, changing its phase. Eventually, as shown in FIG. 7, the second phase protuberance 35*c* is hooked at the switch member 45 that has been restored to the off-state, and rotation of the housing 35 is stopped. The cam 33 is then fixed in position at the second phase where the long radius of the cam 33 faces the upper side. In order to maintain the position of the cam 33 at the second phase, the solenoid unit 40 is instantly turned off. To change the position of the cam 33 to the first phase, the solenoid unit 40 is cycled on and off again.

As is apparent from the foregoing discussion regarding the clutch apparatus according to the present invention, the solenoid is maintained at the on-state only to set the initial position of the cam, and remains in the off-state once the phase has been determined, thus power consumption could be reduced. The phase of the cam is easily changed through on/off cycles of the solenoid unit.

Also, as the phase of the cam is maintained at the off-status, overheating of the solenoid is prevented and its life cycle is extended and malfunction is prevented.

While the present invention has been particularly shown and described with reference to exemplary embodiments thereof, it will be understood by those of ordinary skill in the art that various changes in form and details may be made therein without departing from the spirit and scope of the invention as defined by the accompanying claims and their equivalents.

What is claimed is:

1. A clutch apparatus for performing two-phase position control for a two phase-positioned object installed on a shaft, the clutch apparatus comprising:

a clutch housing for rotating together with the shaft, while supporting the shaft;

a driving gear installed on the housing, for being rotatable and for selectively driving the housing in a rotatable manner with the help of a clutch intervened between the housing and the driving gear; and a solenoid unit for supporting the housing and selectively on/off-controlled, wherein the housing has an initial position controlling protuberance interfered with the solenoid unit in its on-state, for determining an initial position of the object, and a pair of phase protuberances interfered with the solenoid unit in its off-state, for suppressing rotation of the housing at each of the two phase positions of the object.

2. The apparatus according to claim 1, wherein a pair of the phase protuberances is projected on an outer periphery of the housing, for corresponding to a position of a switch member in its off-state that is changed by on/off operation of the solenoid unit.

3. The apparatus according to claim 2, wherein a pair of the phase protuberances is positioned on the same circumference in an outer periphery of the housing.

4. The apparatus according to claim 2, wherein the phase protuberances are installed symmetrically with respect to the shaft.

5. The apparatus according to claim 1, wherein the initial position controlling protuberance is prepared on a position that forms an angle of 90 degrees in a circumferential direction with respect to each of the phase protuberances.

6. The apparatus according to claim 1, wherein interference between the solenoid unit and either of a pair of the phase protuberances is released by instant on/off-operation of the solenoid unit so that phase conversion may be possible.

7. A position control clutch device comprising:

a driving gear and clutch connectable for rotation with a housing;

a shaft connectable for rotation with the housing at one end and having an object at the opposite end; and a solenoid unit adapted to rotatably support the housing and for selectively engaging protuberances on the surface of the housing with a switch member, wherein the switch member engages an initial position controlling protuberance when the solenoid unit is in an on state and the switch member selectively engages either a first phase protuberance or a second phase protuberance when the solenoid is in an off state, whereby the position of the object is controlled in set phases by turning the solenoid on and off.

8. A position control clutch device as in claim 7, wherein the first phase protuberance and the second phase protuberance are on opposing sides of the housing surface.

9. A position control clutch device as in claim 7, wherein the initial position controlling protuberance is disposed on a circumference offset from the first and second phase protuberances.

10. A position control clutch device as in claim 7, wherein the object comprises a cam.

11. A position control clutch device comprising:

a housing rotatably coupled to a shaft, wherein the shaft has a cam at a free end in common rotation with the shaft;

a driving gear and clutch connectable for selective rotation with the housing;

a solenoid unit adapted to rotatably support the housing and for selectively engaging the housing with a switch member;

wherein the switch member selectively engages an initial position controlling protuberance on the surface of the housing when the solenoid unit is on, and a first phase protuberance or a second phase protuberance on the surface of the housing when the solenoid is off, and wherein the cam may change phase by cycling the solenoid on and off.

12. A position control clutch device as in claim 11, wherein the first phase protuberance and the second phase protuberance are on the same circumference line on opposite sides of the housing surface.

13. A position control clutch device as in claim 11, wherein the initial position controlling protuberance is disposed on a circumference line that is offset from the circumference line of the first and second phase protuberances.

14. A position control clutch device as in claim 11, wherein the driving gear and clutch slip and do not provide rotational force to the housing when the switch member engages a protuberance on the housing.

* * * * *

UNITED STATES PATENT AND TRADEMARK OFFICE

CERTIFICATE OF CORRECTION

PATENT NO. : 7,021,439 B2
APPLICATION NO. : 10/736845
DATED : April 4, 2006
INVENTOR(S) : Young-min Yoon et al.

It is certified that error appears in the above-identified patent and that said Letters Patent is hereby corrected as shown below:

On the cover page, column 2, (57) Abstract, line 13, change “two phase” to --two phase--

Column 6, line 8, change “two phase” to --two-phase--

Column 6, line 28, change “may be” to --is--

Column 6, line 39, change “on state” to --on-state--

Column 6, line 42, change “off state” to --off-state--

Signed and Sealed this

Fifteenth Day of August, 2006

JON W. DUDAS
*Director of the United States Patent and Trademark Office*